US009474675B2

(12) United States Patent
Hansen

(10) Patent No.: US 9,474,675 B2
(45) Date of Patent: Oct. 25, 2016

(54) KNEE REHABILITATION APPARATUS

(71) Applicant: Erik M. Hansen, Overland Park, KS (US)

(72) Inventor: Erik M. Hansen, Overland Park, KS (US)

( * ) Notice: Subject to any disclaimer, the term of this patent is extended or adjusted under 35 U.S.C. 154(b) by 427 days.

(21) Appl. No.: 14/094,137

(22) Filed: Dec. 2, 2013

(65) Prior Publication Data

US 2014/0088466 A1 Mar. 27, 2014

(51) Int. Cl.

| | |
|---|---|
| ***A61H 1/02*** | (2006.01) |
| ***A63B 21/04*** | (2006.01) |
| ***A61H 1/00*** | (2006.01) |
| ***A61G 13/00*** | (2006.01) |
| ***A63B 21/055*** | (2006.01) |
| ***A63B 23/04*** | (2006.01) |
| ***A63B 21/00*** | (2006.01) |
| *A63B 23/00* | (2006.01) |
| *A63B 71/06* | (2006.01) |
| *A61G 13/12* | (2006.01) |

(52) U.S. Cl.

CPC ..... *A61H 1/008* (2013.01); *A61G 13/009* (2013.01); *A61H 1/024* (2013.01); *A61H 1/0244* (2013.01); *A63B 21/00061* (2013.01); *A63B 21/00178* (2013.01); *A63B 21/00181* (2013.01); *A63B 21/04* (2013.01); *A63B 21/0428* (2013.01); *A63B 21/0552* (2013.01); *A63B 21/4015* (2015.10); *A63B 21/4045* (2015.10); *A63B 23/0482* (2013.01); *A63B 23/0494* (2013.01); *A61G 13/125* (2013.01); *A61G 13/1245* (2013.01); *A61H 2201/1253* (2013.01); *A61H 2201/1261* (2013.01); *A61H 2201/164* (2013.01); *A61H 2201/1642* (2013.01); *A61H 2201/1664* (2013.01); *A63B 21/0557* (2013.01); *A63B 2023/006* (2013.01); *A63B 2071/0694* (2013.01); *A63B 2208/0252* (2013.01); *A63B 2209/10* (2013.01)

(58) Field of Classification Search

CPC .... A61H 1/008; A61H 1/0244; A61H 1/024; A61H 1/0237; A63B 21/4045; A63B 21/4015; A63B 21/04; A63B 21/0552; A63B 21/0428; A63B 23/0482; A63B 23/0494

See application file for complete search history.

(56) References Cited

U.S. PATENT DOCUMENTS

| | | | | |
|---|---|---|---|---|
| 2,720,396 | A * | 10/1955 | Pfaus | A63B 23/03533 482/130 |
| 3,323,518 | A | 6/1967 | Swanson | |
| 4,844,454 | A * | 7/1989 | Rogers | A61H 1/024 482/131 |
| 5,252,102 | A | 10/1993 | Singer et al. | |
| 5,333,604 | A | 8/1994 | Green et al. | |
| 5,509,894 | A | 4/1996 | Mason et al. | |
| 5,518,483 | A * | 5/1996 | Oswald | A63B 21/012 482/114 |
| 5,582,579 | A | 12/1996 | Chism et al. | |
| 5,645,516 | A * | 7/1997 | Foster | A63B 21/0004 482/121 |
| 5,656,003 | A * | 8/1997 | Robinson | A63B 23/03525 482/100 |
| 5,954,621 | A | 9/1999 | Joutras et al. | |
| 6,267,735 | B1 | 7/2001 | Blanchard et al. | |
| 2004/0049135 | A1 | 3/2004 | Callanan et al. | |

(Continued)

*Primary Examiner* — Justine Yu
*Assistant Examiner* — Timothy Stanis
(74) *Attorney, Agent, or Firm* — Kenneth W. Iles

(57) ABSTRACT

A foot cradle is mounted on tracks on a base for reciprocal motion for passive knee flexion or resistance knee flexion in either direction along the axis of the rectangular base. Resistance is supplied by resistance bands connected at both ends of the base and connected to the foot cradle. The foot cradle can be fixed in any desired position for assisted knee straightening exercises. The patient's foot is secured in the foot cradle by straps and a thigh strap keeps the patient's upper thigh in proper relationship to the apparatus.

11 Claims, 6 Drawing Sheets

(56) References Cited

U.S. PATENT DOCUMENTS

2005/0221965 A1* 10/2005 Boland ..... A63B 21/0004
482/121
2008/0248933 A1* 10/2008 Suiter ..... A63B 21/0552
482/122
2010/0016131 A1* 1/2010 Hoffman ..... A63B 21/055
482/121
2012/0022410 A1 1/2012 Peach
2012/0035512 A1* 2/2012 Su ..... A61H 1/0281
601/5
2012/0065030 A1* 3/2012 Sandvig ..... A63B 21/0442
482/79

* cited by examiner

KNEE REHABILITATION APPARATUS

CROSS-REFERENCE TO RELATED APPLICATIONS

Not Applicable.

STATEMENT REGARDING FEDERALLY SPONSORED RESEARCH OR DEVELOPMENT

Not applicable.

SEQUENCE LISTING

Not applicable

BACKGROUND OF THE INVENTION

The present invention is related to an apparatus and process for rehabilitating a person's knee before and after surgeries or injuries that affect the mobility of the knee, such as partial or full knee replacement, hip replacement and the like. More particularly, the present invention provides an apparatus that allows a patient to substantially replicate the therapeutic movements of a physical therapist alone or with the assistance of another providing the patient with the opportunity for more therapeutic movement of the knee or other joint that would typically be available through a licensed therapist and may lead to a quicker and more complete recovery.

DESCRIPTION OF THE RELATED ART INCLUDING INFORMATION DISCLOSED UNDER 37 C.F.R. 1.97 AND 1.98

Following certain injuries, surgery or other medical treatments that affect the mobility of the knee, it is customary for the patient to have physical therapy provided by a licensed physical therapist to increase the degree of bending in the knee, the amount of extension, that is, straightening of the knee that the patient can tolerate or maintain. Some types of events that can impair the flexion or the extension of the knee and will therefore require therapy include, for example, any knee operation, such as a total knee replacement or anterior cruciate ligament replacement, hip replacements, stroke (cardiovascular accident) and so forth. In the case of a partial or total knee replacement, for example, without rehabilitation, the knee may never extend out completely or bend as far as necessary for normal activities. For example, without rehabilitative therapy, the patient may never be able to walk properly or return to independent daily activities and could potentially suffer from back pain, hip pain and knee pain. Effective therapy for recovery from a total knee replacement surgery takes about eight to twelve weeks, whereas recovery from an anterior cruciate ligament (ACL) surgery is about six to nine months. Therapeutic exercises must be done throughout these recovery periods if more-or-less normal function of the knee is to be achieved.

In knee rehabilitation, the progressive stretch exercise is designed to progressively extend the knee, beginning with a static stretch in which simply the weight of the leg in a basically horizontal position straightens the knee joint to a degree. Generally, this is as much force as can be tolerated by the patient immediately following surgery. As therapy progresses, a downward force stretching a patient's knee into extension may be necessary. Gradually the patient is able to tolerate more force and the ligaments, etc. stretch, allowing the knee joint to be progressively straightened. The goal is to get the knee to be completely straight with no bend in the knee.

A second critical exercise is designed to increase the flexion of the knee, that is, the angle at which the knee can be bent through active, active assisted and passive range of motion movement, that is, moving the knee up, drawing the foot closer to the patient's body, and then down, moving the patient's foot farther away from his body. Active range of motion (AROM) is defined as moving a body part without the assistance of another. Active Assisted Range of Motion (AAROM) is defined as moving a body part with the assistance of another. Passive range of motion (PROM) is defined as moving a body part with only the assistance of another. Progressive resisted exercises (PRE) are defined as movement of a body part against outside resistance. Normal range of motion of the knee is considered to be 0° of extension and 135° degrees of flexion. The goal after any knee injury or surgery is to improve or restore range of motion that a patient had prior to the injury or surgery.

To increase flexion in the knee, a physical therapist typically uses passive range of motion. This is usually done with the patient in a supine or seated position. The physical therapist pulls the patient's foot forward toward the patient's body, while supporting the underside of the knee, causing the knee to rise and thereby increasing the flexion angle of the knee. This is done on a frequent basis and angles are measured to quantify progress. Also, patients can use the assisted strap and perform active assisted range of motion exercises themselves to increase flexion of the knee. To increase flexion, the therapist begins with the patient lying on his back with his leg extended and the knee as straight as possible and then the therapist pulls the patient's foot toward the patient's body, while supporting the underside of the knee, causing the knee to rise and thereby increasing the flexion angle of the knee. This is done until the patient's knee joint is loosened up. In the passive movement, the therapist cups the patient's heel in one hand, say his left hand, and places his other hand, that is, his right hand, under the back of the patient's knee. Then the therapist moves his left hand up, bending the knee at a sharper angle, the guiding the knee up and down, while moving the heel as required by the movement of the knee. The therapist moves the knee up and down in an oscillating movement. Allowing the knee to descend decreases the angle of the bend of the knee. This exercise is strictly passive and does not involve the use of the patient's muscles, which remain relaxed throughout the procedure during the stages of rehabilitation, with more force being applied as the flexion angle is increased over time. The goal is to reach maximum range of motion potential for that individual patient.

Passive range of motion exercises should be performed daily. Passive range of motion exercises, that is, passive flexion exercises, are conducted until the maximum range of motion is achieved.

Clearly, intensive work by the therapist is required because these movements must be repeated so frequently each day and for a total of perhaps many months. Some patients are homebound during some or all of the rehabilitation period and so the therapist must go to the patient's home. This setup is a very time-consuming, inefficient and costly process. Some efforts have been made to train others, for example, the wife or husband of the patient, to perform these exercises. Such efforts have achieved mixed results, however, due to lack of patient and caregiver compliance, insufficient training to replicate the skill of the licensed therapist in rudimentary exercises, and so forth.

These considerations have led some to try to develop a machine that can substantially reproduce the efforts of the licensed physical therapist so that reasonably acceptable therapy can be conducted by the patient.

For example, Published Patent Application US 2012/022410 A1 was published on Jan. 26, 2012 for an invention by Peach entitled Knee Extension Therapy Device, which includes a base with an attached cuff for restraining the user's leg adjacent to his hip while the lower leg is placed in a cradle that is higher than the patient's knee. An inflatable bladder is placed in the cradle under the patient's lower leg and can be inflated by a hand pump operated by the patient. This invention is limited to performing knee extension therapy, but this therapy is not well controlled because the amount that the patient's lower leg is raised by inflating the bladder is not measured. The device is not designed for flexion exercises, whether passive or performed under resistance and so it cannot be the only instrumentality used for complete therapy.

U.S. Pat. No. 5,333,604, issued to Green et al. on Aug. 2, 1994 for a Patella Exercising Apparatus includes a base that lies adjacent to a patient leg. The base supports an elaborate and large mechanical linkage, including a pivoting member that supports the patient's leg. The leg supporting member itself pivots in the middle so that the front portion drops down, bending the user's knee. A reversible drive motor actuates the numerous and various pivoting linkage members to induce mechanical bending of the knee, which is strapped to the leg support member. This device is quite large an unwieldy, making portability problematic. Further it is complex and cumbersome and it is ill suited to promoting knee straightening exercises. As a continuous passive motion (CPM) device, it cannot be used for rehabilitation after the first few weeks following surgery, when resistance must be added in order for the patient to regain lost strength and range of motion using his own muscles.

U.S. Pat. No. 5,252,102, issued to Singer et al. On Oct. 12, 1009 for an Electronic Range of Motion Apparatus for Orthosis, Prosthesis and CPM Machine an electric motor is used to drive a transmission having reduction gears, which rotate to pull a rod back and forth. The patient wears a knee brace that bends at the knee. One end of the reciprocating rod is fixed to the knee brace above the knee and the other end is fixed to the knee brace below the knee. Therefore when the rod reciprocates, the knee bends and straightens. Much computer aid and software are included with this device. This device is a passive continuous motion device and is therefore unsuitable for the necessary resistance training that must be done.

U.S. Pat. No. 6,267,735 B1, issued to Blanchard et al. on Jul. 31, 2001 for a Continuous Passive Motion Device Having a Comfort Zone Feature includes a frame with a yoke for receiving the patient's hip and an elevated yoke that slopes down from above the patient's hip, with a closed end that supports the patient's lower leg, which is fixed to the lower leg support. The lower leg support is attached to the back of the hip yoke with an elaborate linkage. A threaded drive rod runs the length of the frame and is rotated in either direction by a motor. A threaded coupling on the lower leg support receiving portion of the yoke is moved back and forth, thereby raising and lowering the knee. The device is electronically controlled. Using this device is so comfortable for patients that they sometimes stay in bed and do very little but allow the machine to raise and lower their knee for many hours, sometimes leading to diseases associated with immobility. Further, the device is quite heavy, expensive and complex. Perhaps most importantly, it is capable of passive exercise only and so cannot be the only device used in full rehabilitation. Its use may also set back or prevent a full recovery because it feels so good to use that a patient may delay the crucial resistance exercises that are required for an optimal recovery.

These and other inventions tend to be single purpose, that is, passive, complex and expensive. Their size and complexity may deter patients from being able to perform a significant amount of their own therapy.

Therefore, there is a need for an apparatus that allows a patient to perform flexion exercises that may be passive, active, active assisted or progressive resisted and to perform knee extensions and straightening that is simple, inexpensive to manufacture and that is simple and easy for a patient to use without assistance.

BRIEF SUMMARY OF THE INVENTION

Accordingly, it is the primary objects of the present invention to provide a knee rehabilitation apparatus that allows a patient to perform flexion exercises that are active, active assisted, passive or progressive resistance and to perform knee extensions and straightening exercises; that can be used by a licensed rehabilitation professional to assist in achieving optimal range of motion of the patient's knee; and that can be used by a patient with the assistance of a family member family member to achieve high-quality rehabilitation treatments without the presence of a licensed rehabilitation professional.

It is another object of the present invention to provide a knee rehabilitation apparatus that is simple to use.

It is another object of the present invention to provide a knee rehabilitation apparatus that is less expensive to manufacture than prior art devices.

It is another object of the present invention to provide a knee rehabilitation apparatus that is simple for a patient to use without assistance.

Functionally, a knee rehabilitation apparatus according to the present invention allows patients and rehabilitation professionals, such as a licensed physical therapist, to perform many recognized therapeutic exercises, either by the patient alone, or with the assistance of another person or licensed physical therapist, without the need for expensive electronics, complex moving parts, computer software and so forth. A knee rehabilitation apparatus according to the present invention allows for easy passive range of motion (PROM) exercises performed on the patient by another person; for easy active range of motion (AROM) exercises performed by the patient; assisted active range of motion (AAROM) exercises by the patient utilizing an assist strap, allowing the patient to use his own arms to assist the proper movement of his leg; for progressive resisted movements exercises (PRE's), using resistance bands; progressive static stretching both in extension and flexion, with extension exercises utilizing the extension strap and flexion using the foot cradle lock, with supervision. An assist handle on the knee rehabilitation apparatus allows a licensed professional physical therapist to move the foot cradle easily for both extension and flexion exercises, as well as to lock the knee in at a desired angle, allowing the therapist to perform soft tissue therapy, without the therapist's having to hold the patient's leg during the soft tissue work.

These objects of the invention are accomplished by providing a base having a pair of parallel rails fastened to it, with a foot cradle mounted onto the tracks so that the foot cradle can move easily along the rails. The patient's foot is strapped into a heel cup, which is pivotally mounted onto one end of the foot cradle and the patient's upper leg is strapped to the proximal end of the frame. The patient can move his leg back and forth, bending and straightening his knee, resulting in early active range of motion exercise. The patient can also move his leg back and forth with the use of the assisted strapped, allowing for active assisted range of motion. Alternatively an assistance can slide the foot cradle back and forth along the rails by pushing and pulling on a handle mounted on the distal end of the foot cradle.

Resistance bands can be fastened to a number of points on the frame and on the foot cradle so that the patient can train with actual force resistance when the time for passive motion is over. Resistance bands of different thickness require different amounts of force to pull or push the leg over a desired distance. The forces needed to stretch various resistance band are well-known and well calibrated. Thus, the knee rehabilitation apparatus can be used for both passive and resistance knee flexion exercises.

A rack, that is, a bar having parallel spaced teeth cut into it, is fixed to the base and runs the length of the working area of the knee rehabilitation apparatus between the rails and parallel to them. The handle can be moved up and down in a part of parallel slots and has a brake block, consisting of a section of the same stock as the rack itself, in its lower end that mates with the crests and troughs in the teeth of in the rack when the handle is lowered. This procedure locks the foot cradle into one fixed position, allowing the patient's knee to be locked a desired angle by the rehabilitation professional. The patient's knee can be locked into place at any knee angle within the patient's available range of motion. This allows a rehabilitation professional to have more control of the patient's leg during treatments. This also allows for the patient's knee to be locked in to a flexed position to add static stretching of the patient's knee to the patient's exercise regimen.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE INVENTION

Figure 1:
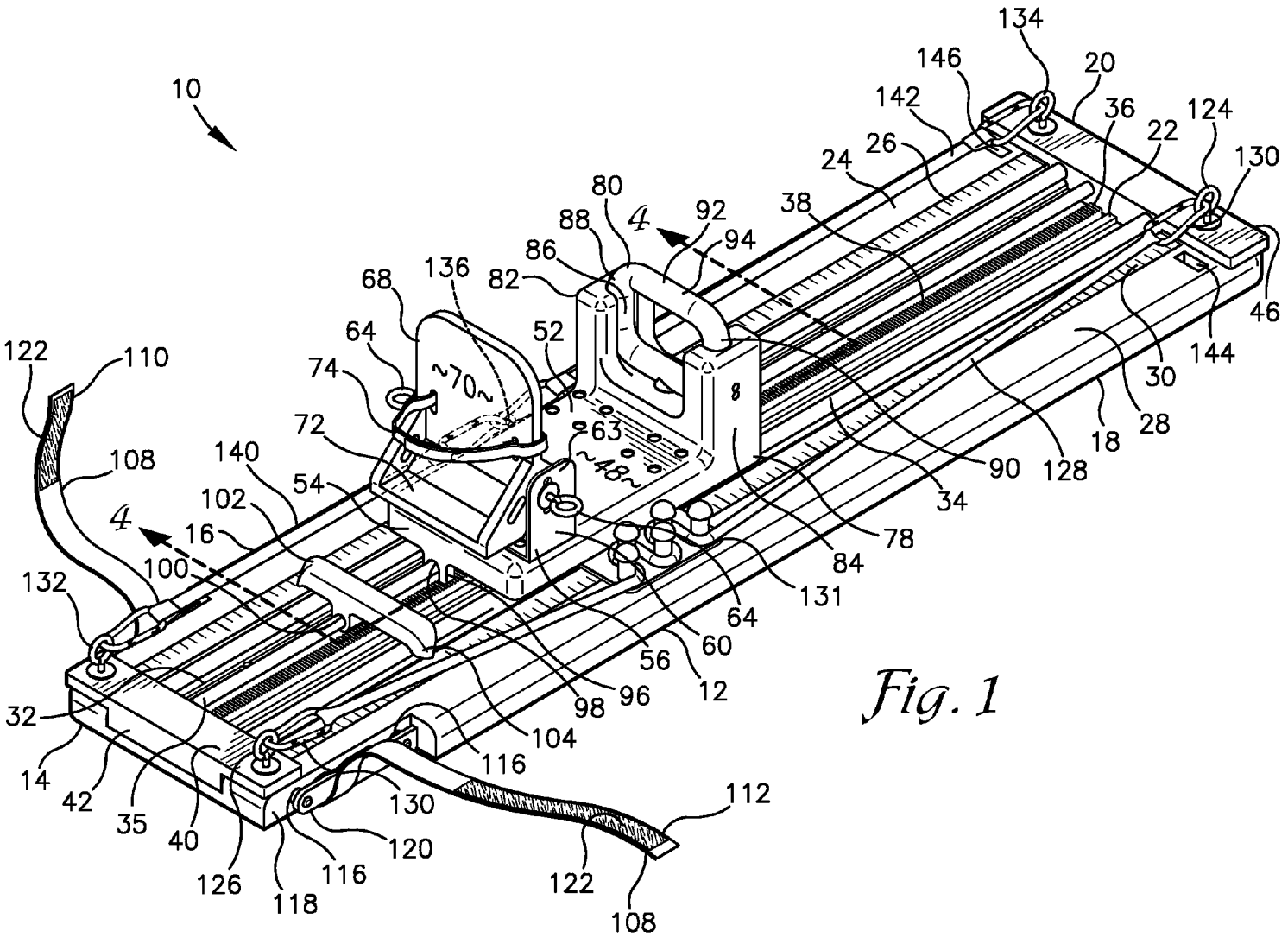
FIG. 1 is an isometric view of a knee rehabilitation apparatus according to the present invention.

Referring to FIG. 1, a knee rehabilitation apparatus 10 in accordance with the invention includes a base 12 having a proximal end 14, that is adjacent to the patient's hip when the knee rehabilitation apparatus 10 is in use, a left side 16, a right side 18 and a distal end 20, with the four sides forming a rectangle in a top or bottom view. A broad channel 22 is formed along the entire length of the base 12, that is, a longitudinal channel in the base 12, which has a rectangular top view, creating a left side flat marginal strip 24 having a measuring rule 26 marked on it and a corresponding right side flat marginal strip 28 having a measuring rule 30 marked on it. The channel 22 lies through the center of the width of the base 12. The measuring rules 26, 30 may be marked in any convenient units of measure, such as inches, millimeters, or the like and the measurement markings line up for both measuring rules 26, 30. Alternatively, if desired, one measuring rule may be marked in inches and the other in millimeters, or both measuring rules may carry marks for both inches and millimeters, etc. The measuring rules 26, 30 may be marked directly onto the surfaces of the right side and left side strips 24, 28 or may be separate measuring rules embedded in or glued to the right side and left side flat marginal strips 24, 28.

Still referring to FIG. 1, a left side rail 32 and a right side rail 34 lie in, are seated in, and are fixed to the bottom wall 36 of the channel 22, and are parallel to one another and project upwardly from the bottom wall 36. Disposed in the middle of the space between the left side rail 32 the right side rail 34 and parallel to each of them lies a rack 38, that is a toothed bar having a plurality of evenly spaced upstanding teeth, which is also seated in and fixed to the bottom wall 36 of the channel 22.

Figure 2:
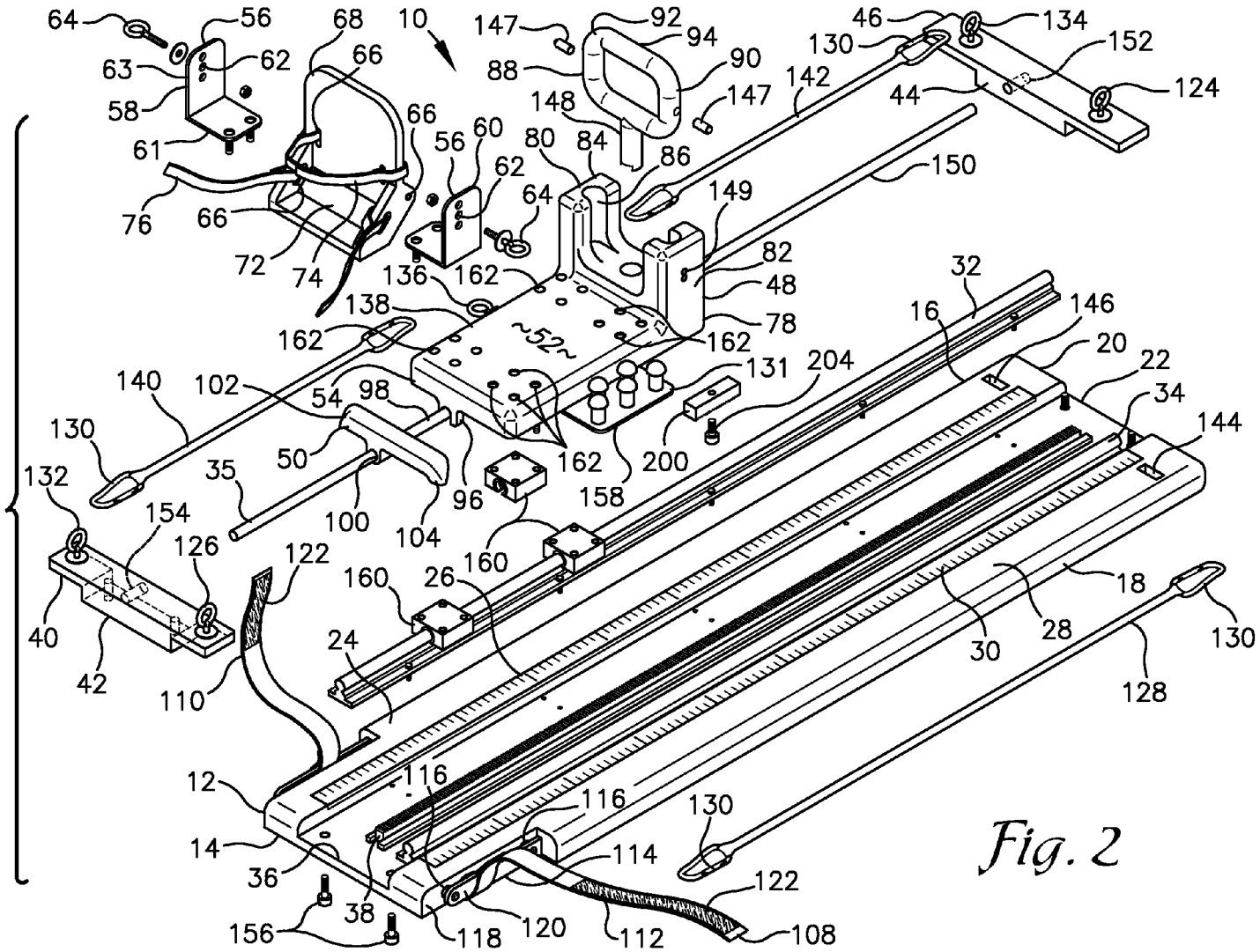
FIG. 2 is an exploded isometric view of the apparatus of FIG. 1.

Still referring to FIG. 1, an end cap 40 comprising a rectangle in top view includes a depending tongue portion 42 that fits into the channel 22, seals the channel 20 at the proximal end 14 of the base 12 and is removably fixed to the base 12 by fasteners (FIG. 2). The tongue portion 42 itself comprises a rectilinear solid. An identical end cap 46 seals the channel 22 at the distal end 20 of the base 12. These end caps 40, 46 prevent the foot cradle 48 or the progress indicator 50 from sliding off the ends of the left side and right side rails 32, 34, but can be removed to facilitate repairs, replacement of parts and so forth.

Still referring to FIG. 1, the foot cradle 48 includes a flat base portion 52. Adjacent to the proximal end 54 of the base portion is an upstanding mounting yoke 56 having parallel vertical mounting members, that is the left side upstanding bracket 58 (shown in FIG. 2) and the right side upstanding bracket 60. Each bracket 58, 60 is a right angle bracket having a flat base portion 61 and an upstanding portion 63, with the base being fixed to the top surface of the flat base portion 52 of the foot cradle 48 by screws or the like. An eyebolt 64 that passes through the apertures 62 and through the apertures 66 in a foot cup 68 having a foot portion 70 and an internally formed heel portion 72. The foot cradle 48 pivots freely about the axis formed by the left and right eyebolts 62. A strap 74 adjacent to a toe portion 76 of the foot portion 70 secures the front portion of the patient's foot, while a leg strap 76 adjacent to the top of the heel portion 72 secures the patient's lower leg to the foot cup 68 and maintains the patient's heel in contact with the heel portion 72 of the foot cup 68. The straps 74, 76 can be adjusted to provide the desired amount of restraint to the patient's foot and then released after therapy. The straps 74, 76 may be secured by hook-and-loop fasteners, buckles and so forth.

Still referring to FIG. 1, adjacent to the distal end 78 of the foot cradle 48 and part of the foot cradle is a handle bracket 80 having a left side upstanding bracket member 82 and a spaced parallel right side upstanding bracket member 84, each having a concave groove 86, for receiving the left and right vertical ends 88, 90 of a handle 92 describing basically a rectangle shape having a top bar 94. An assistance to the patient, grasps the top bar 94 of the handle 92 and moves the foot cradle 48 closer to and farther from the patient during passive flexion therapy. Having the vertical ends 88, 90 of the handle 92 seated in the grooves 86 strengthens the attachment of the handle 92 and allows the assistant to apply greater force to the handle 92 than the structure would otherwise allow.

Still referring to FIG. 1, the flat base portion 52 includes eight apertures 162 (See FIG. 2) that are visible in FIG. 1, arranged into square blocks, for attaching bearing blocks, which are discussed below in connection with FIG. 2. An integrally formed tongue member 96 protrudes beneath the bottom surface of the flat base portion 52. A concave channel 98 is formed in the tongue member 96 and has a cross-section profile that substantially matches the cross-section profile of the guide rail 35. The concave channel 98 runs the length of the flat base portion 52 and rides on the guide rail 35, ensuring that the foot cradle 48 remains parallel to the rails 32, 34 as it is moved back and forth. The foot cradle 48 can be installed on the left side rail 32 only when one or both end caps 40, 46 are removed.

Still referring to FIG. 1, the progress indicator 50 includes a similar channel structure 100 that secures the progress indicator 50 the guide rail 35 and allows the progress indicator 52 to slide back and forth along the guide rail 35. Both ends of the progress indicator 50 includes a wedge-shaped tapered end forming a point, forming a left side pointer 102 that lies above the left side measuring rule 26 and a right side pointer 104 that lies above the right side measuring rule 30. In use, the patient will butt the progress indicator 50 against the proximal end 54 of the foot cradle 48. Then when the patient contracts his knee, drawing the foot cradle 48 toward his body, the progress indicator 50 will slide farther along the measuring rules 26, 30. The patient will leave the progress indicator 50 at its point of farthest movement and record the results. When flexion has increased, the patient will be able to advance the progress indicator 50 further, thereby providing a visual and written record of day-to-day increases in his flexion. The progress indicator 50 can be installed on the guide rail 25 only when one or both end caps 40, 46 are removed.

Still referring to FIG. 1, a and upper thigh strap 108 consists of a left portion 110 and a right portion 112, each having a proximal end and a distal end. A strap retaining bracket 114 is formed by screwing to spaced parallel collars 116 into a rectangular notch 118 in the side edge of the base 12, with a plate 120 on the outside of the collars 116, thereby providing a retaining bracket 114 for securing the proximal ends of the left and right portions 110, 112 of the thigh strap 108. This structure keeps the brackets inside of the perimeter defined by the rest of the edges of the base 12, thereby reducing the likelihood that the brackets 114 will cause injury or will damage other things. The distal ends of the strap portions 110, 112 are fastened together by any convenient conventional means, such as the illustrated hook and loop fasteners 122.

Still referring to FIG. 1, when unconstrained, the foot cradle 48 moves freely in reciprocal motion parallel to the rails 32, 34, but when active flexion exercises introduced to a patient's rehabilitation regimen, some resistance to this movement must be imposed in order to invoke and involve the patient's muscles in the exercise. Two methods of providing resistance to movement in either direction are illustrated here.

Still referring to FIG. 1, an eyebolt 124 is anchored at the distal end 20 of the right side marginal flat strip 28 of the base 12 and a corresponding eyebolt 126 is anchored at the proximal end 14 of the right side marginal flat strip 28 of the base 12. The corresponding ends of a single resistance band 128 are anchored to the eyebolts 124, 126 by the spring brackets 130. Alternative types of anchor points may be used in regard to any eyebolt or the like described in this paper as a point for restraining ends of a resistance band. Resistance bands are very commonly used for many various types of exercises and are readily available in different bands that require different force to stretch. In the middle of the length thus defined lies a resistance band five pin tensioning device 131 consisting of five upstanding pins arranged in a specific pattern, about which the resistance band 128 is routed, as discussed in detail in connection with FIGS. 5, 6. This arrangement provides resistance to the movement of the foot cradle 48 as it is moved toward either the proximal and 14 or the distal end 28 of the base 12. An advantage of this tensioning system is that it permits the use of a single resistance band 128 for achieving resistance to flexion toward either the distal end 20 or the proximal end 14. It also allows for a reduction in the tension in both directions by changing the routing of the resistance band 128 around the five pins. A disadvantage of this system is that it makes precise calibration of actual resistance to flexion difficult to discern.

Still referring to FIG. 1, an alternative means for adding resistance to the movement of the foot cradle 48, an eyebolt 132 is anchored into the proximal end 14 of the base 12 along the left side flat marginal strip 24 and a corresponding eyebolt 134 is anchored into the distal end 28 of the base 12 along the left side flat marginal strip 24. As shown in more detail in FIG. 2, an eyebolt 136 is anchored into a left side edge 138 of the foot cradle 48. Two separate resistance bands are attached to the knee rehabilitation apparatus 10 in this instance. A proximal end resistance band 140 is attached to the eyebolt 132 and to the eyebolt 136, which is fastened to the foot cradle 48, by the spring brackets 130 (FIG. 2), thereby providing resistance to flexion movement toward the distal end 20 of the knee rehabilitation apparatus 10. A distal end resistance band 142 is connected to the eyebolt 136 in the foot cradle 48 and to the distal end eyebolt 134, thereby providing resistance to movement of the foot cradle 48 in flexion motion toward the proximal end 14 of the knee rehabilitation apparatus 10. In this case, the amount of resistance to movement in either direction can be different and in any case can be increased or decreased by changing the resistance bands themselves to resistance bands of different strengths, which have been carefully calibrated by manufacturers of resistance bands. As an alternative or addition to the eyebolts 124, 134 in the distal end 20 of the knee rehabilitation apparatus 10, are a right side rectangular aperture 144 and a left side rectangular aperture 146. A resistance band or the like may be fastened by looping it through either the aperture 144 or the aperture 146 and tying it, securing it with a buckle or the like.

Still referring to FIG. 1, lying in the channel 22 that runs along the centerline of the base 12, there are for longitudinal members that run the length of the channel 22, which, progressing from left to right, are the left side rail 32, the guide rail 35, the rack 38, and the right side rail 34. Each of these members is fastened to the bottom wall 36 of the channel 20 by suitable fasteners, such as screws, which may be inserted into flanges that run along the bottom edges of these members or through the tops of them. Alternatively they may be attached by adhesive or the like, or the entire base structure with these members, but without end caps may be machined or molded or the like.

Referring to FIG. 2, the handle is 92 includes a central depending plunger member 148 that terminates in a brake block, i.e., a segment of rack (See FIG. 7) that engages the troughs in the rack 38 to provide a positive stop at any desired location along the rack 38 for the foot cradle 48. The handle 92 is locked into an up position by the internal spring-loaded ball fittings 147 that press into the apertures 149 adjacent to the top of the arms of the handle bracket 80. The restraining force of these fittings 147 is easily overcome by simply pushing down on the handle 92, which allows a brake block (See (See FIG. 7) on the plunger member 148 to engage the rack 38.

The guide rail 35 is shown as a rod, but may be a full three-dimensional rail identical to the left side and right side rails 32, 34. When the guide rail 35 is a rod, the distal end of the guide rod 150 is seated in a bore 152 in the distal end 46 and the proximal end of the guide rail 35 is seated in a bore 154 in the proximal end 40. The end caps 40, 46 are secured to the base 12 by screws or the like, such as the screws 156. The five pins of the five-pin tensioning device 131, in which the pins are arranged in a trapezoidal shape when viewed from above, are seated on a flat flange member 158 that is fastened to the bottom of the foot cradle 48 by screws or the like. Bearing blocks 160 are fastened to the bottom surface of the foot cradle 48 by screws or the like inserted through the apertures 162. There are four bearing blocks 160, arranged in a square shape, so that two bearing blocks 160 ride along the left side rail 32 and to ride along the right side rail 34. The bearing blocks 160 contain ball bearings or roller bearings about a channel 160. Alternatively, the bearing blocks may simply include bushing surfaces shaped to match the cross-section of the rails 32, 34.

Figure 3:
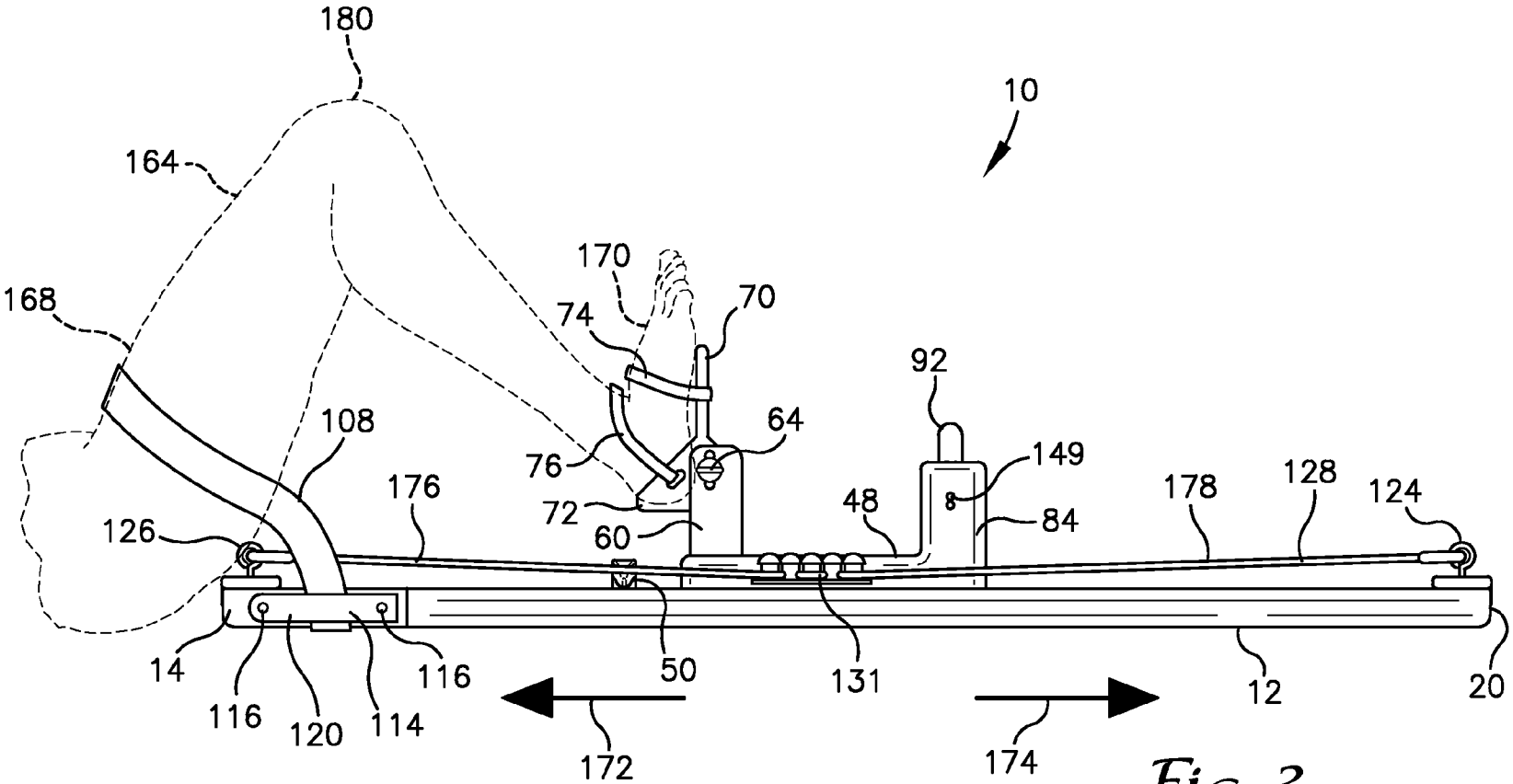
FIG. 3 is a schematic side view of the apparatus of FIG. 1 shown in use by a patient performing a knee flexion exercise.

Referring to FIG. 3, the knee rehabilitation apparatus 10 is shown in use by a patient whose leg 164 is secured to the knee rehabilitation apparatus 10, with his upper thigh 168 secured by the upper thigh strap 108 foot cup 68 by the strap 74 in the foot portion 70 and the ankle strap 76 in the heel portion 72 of the foot cup 68. As shown, the knee rehabilitation apparatus 10 is using the single resistance band 128 which has been routed about the 5-10 tensioning device 131, which effectively divides the resistance band 128 into a proximal segment 176 and a distal segment 178, which are substantially isolated from one another in the tightest routing configuration, as explained below in relation to FIGS. 5, 6. When the patient contracts his leg, that is, moves it in the direction of the arrow 172, thereby bending his knee 180 more sharply, the distal segment 178 of the resistance band 128 becomes more taut throughout the motion, thereby supplying resistance to the motion, while the proximal segment 176 becomes slack. When the patient extends his leg 164, that is, moving in the direction of the arrow 174, increasing the angle of his knee 180 and pushing his foot 170 closer to the distal end 20 of the knee rehabilitation apparatus 10, the proximal segment 176 of the resistance band 128 becomes more taut, thereby resisting the motion, while the distal segment 178 of the resistance band 128 becomes slack. During rehabilitation, the patient may repeat this reciprocal motion 10 to 30 times over as great a distance as he can manage. Over time, it is anticipated that both the range of motion in both directions will increase and that the resistance will be increased through the use of different resistance bands. The patient can perform these exercises without any assistance, if desired.

Figure 4:
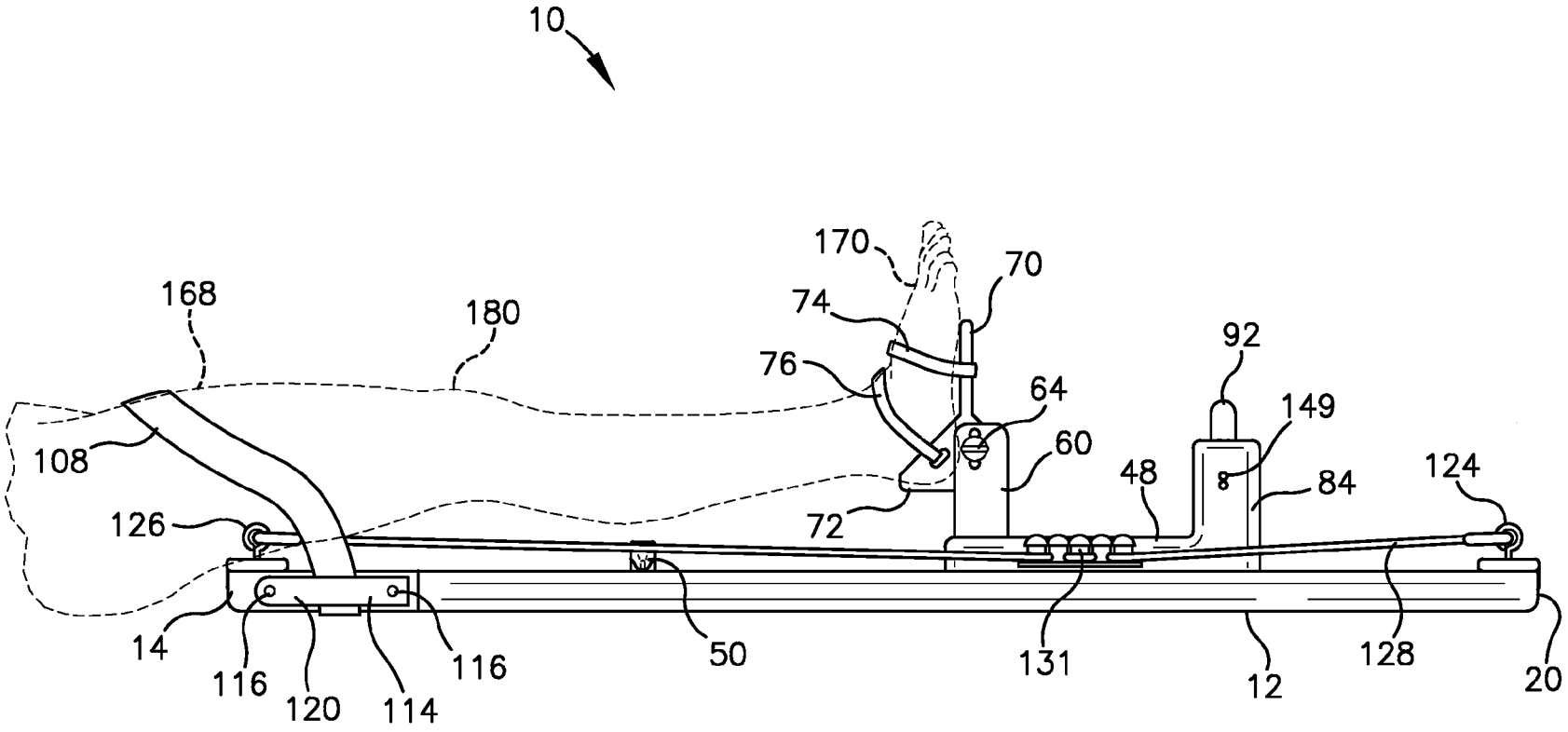
FIG. 4 is a schematic side view of the apparatus of FIG. 1 shown in use by a patient performing a knee straightening exercise.

Referring to FIG. 4, the knee rehabilitation apparatus 10 is shown in use by a patient for a knee straightening exercise. In this case, the patient's leg 164 is restrained as described in reference to FIG. 3, above. The difference is that the foot cradle 48 has been moved to a position closer to the distal end 20 of the base 12 such that the patient's 180 is approximately straight. The knee 180 will have a bend in it and should have a progressively smaller bend over time as therapy progresses. In this exercise, the foot cradle 48 is in a fixed stationary position because the handle 92 has been pushed down so that a brake block (see FIG. 7) fastened to the bottom of the plunger member 148 of the handle 92 engages the troughs in the rack 38, as described in more detail in connection with FIG. 7, below. In this exercise and assistant (not shown) pushes down on the top of the patient's knee 180 to promote stretching that gradually reduces the bent knee and associated with stiffness and over time restores the patient's ability to completely straighten the knee. As shown in FIGS. 3, 4, the thigh strap 108 is shown loose and in the process of being positioned. When fixed into position for exercises utilizing the thigh strap 108, the thigh strap 108 is roughly vertical and perpendicular to the plane of the base 12. Further, the angle of the patient's ankle to his shin is typically approximately perpendicular to his shin or calf and is roughly 45° above horizontal or below vertical.

Figure 5:
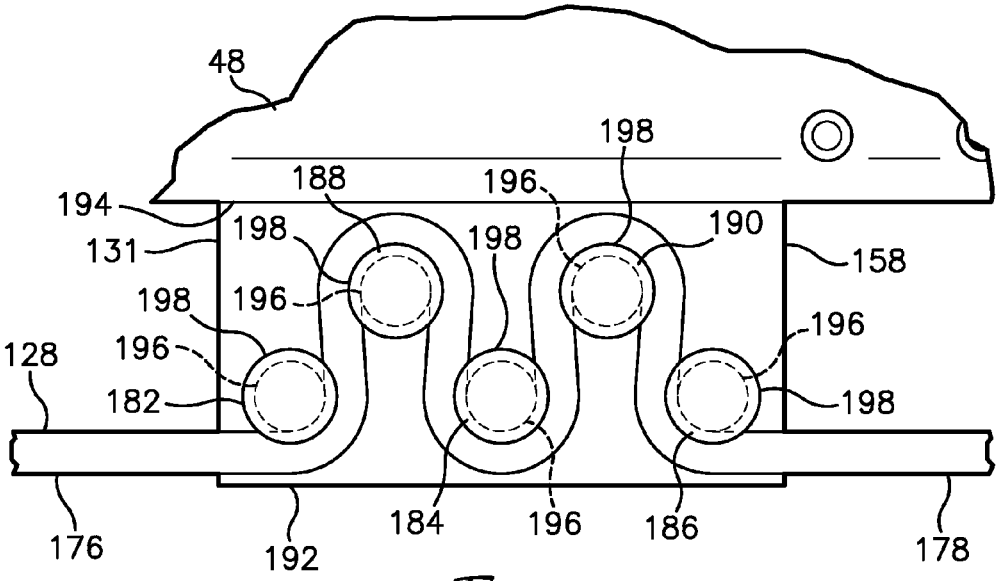
FIG. 5 is a top view of a portion of the apparatus of FIG. 1 showing a tensioning system for a resistance band in a configuration to provide minimal slippage of the resistance band.

Referring to FIG. 5, the five-pin tensioning device 131 is shown with a routing configuration of the resistance band 128 that provides the greatest isolation between the proximal and segment 176 and the distal end segment 178 of the resistance band 128. Because the resistance band 128 is flexible, routing it through the pins of the five-pin tensioning device 131 can be accomplished while both ends of the resistance band 128 are attached to their respective eyebolts 124, 126. A row of three aligned pins, namely the front left pin 182, the center front pin 184, and the right front pin 186 lie adjacent to the outer edge 192 of the flange member 158, while set back from them toward a rear edge 194 of the flange portion 158 lie the left rear pin 188 and the right rear pin 190, which are aligned a line that is parallel to the line formed by the three front pins 182, 184, 186. The left rear pin 188 is also aligned in the center of the distance between the front pin 182 and the center front pin 184, that is, along a line perpendicular to the outer edge 192 that runs between the outer edge 192 in the inner edge 194. The right rear pin 190 lies in the middle of the distance between the center front pin 184 and the right front pin 186, that is, along a line running between the outer edge 192 and the inner edge 194 and perpendicular to the edge 192. In the configuration of FIG. 5, the resistance band 128 is passed about the left front pin 182 where it is closest to the outer edge 192, then passed about portion of the left rear pin where it is closest to the inner edge 194, then about the center front pin 184 in the portion closest to the outer edge 192, then about the portion of the right rear pin 190 that is closest to the inner edge 194 and then routed about the right front pin 186 in the portion of that pin that is closest to the outer edge 192. This configuration places so much friction on the portion of the resistance band 128, which tend to be made of a naturally-friction material like rubber in any case, that the resistance band 128 is virtually converted into two isolated bands, namely the proximal end segment 172 and the distal end segment 174. When the resistance band 128 is routed in the configuration shown, there is virtually no slippage of the resistance band among the pins. The pins 182, 184, 186, 188 and 190 are all fixed to the flange 158 by conventional means, such as screws or other fasteners inserted through the flange 158 and into the pins, Each of the pins 182, 184, 186, 188 and 190 is the same, having a cylindrical body 196 with a mushroom-shaped top 198, which provides a diameter larger than that of the cylindrical body 196 and which therefore prevents the resistance band 128 from slipping off the pins.

Figure 6:
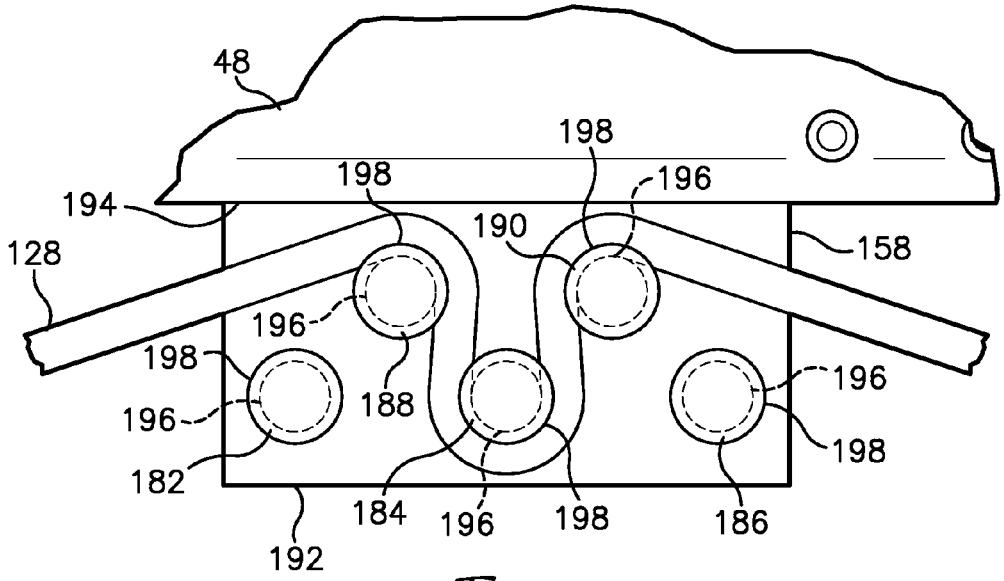
FIG. 6 is a top view of the tensioning system for a resistance band of FIG. 5, with the resistance band shown in the configuration to allow slippage and thereby decrease the resistance felt by the patient.

Referring to FIG. 6, the resistance band 128 is first routed about the left rear pin 188 where it is closest to the inner edge 194 and then about the center front pin 184 where it is closest to the front edge 192 of the flange 158 and then routed about the right rear pin 190 where it is closest to the inner edge 194 of the flange 158, thereby providing a basically U-shaped configuration. This configuration allows some slippage of the foot caddie 48 along the resistance band 128 in either direction of travel, thereby reducing the resistance load experienced by the patient. An advantage of this configuration is that it allows the patient to change the amount of resistance significantly without having to change to a different resistance band.

Figure 7:
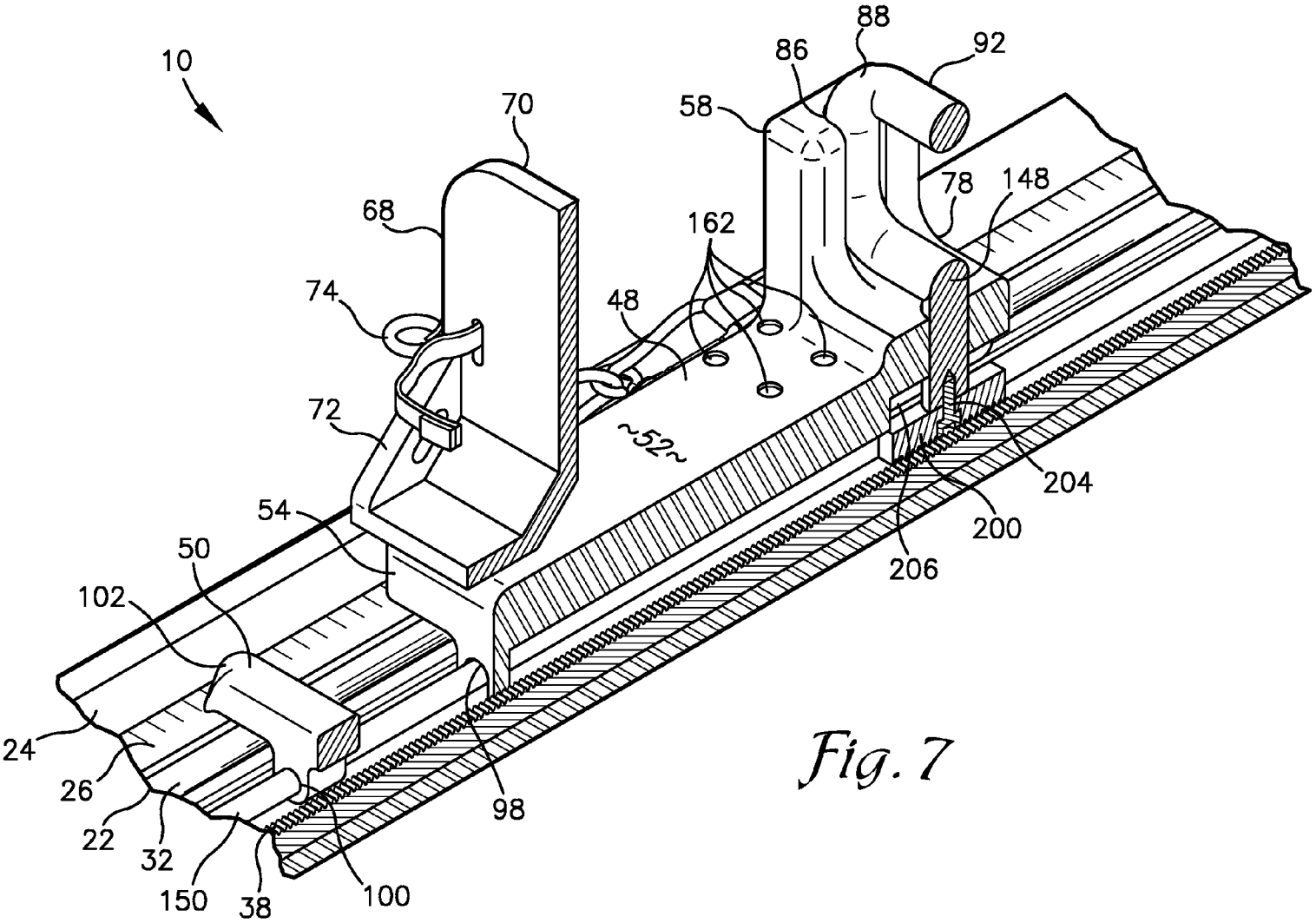
FIG. 7 is a cross section enlarged isometric view of a portion of the apparatus of FIG. 1 taken along the lines 7-7 of FIG. 1.

Referring to FIG. 7, a brake block 200 is fastened to the lower end of the plunger member 148 of the handle 92 by a screw 204, that is, the brake block 200 depends from the handle 92. The brake block 200 is conveniently a segment of a rack, and is a section of the same material of the rack 38, so that the troughs and crests of their teeth mate and the brake block 200 engages the rack 38. When the handle 92 is pressed fully downward, the brake block 200 engages the rack 38, firmly locking the foot cradle 48 into the fixed position selected by the user, which will nearly always be a position in which the patient's knee 180 is slightly bent but can be straightened by downward force. When the handle 92 is pulled up, the brake block 200 is pulled into a brake block recess 206 in the bottom of the foot cradle 48 so that it is above the rack 38 and the foot cradle 48 is free to move easily in reciprocal motion. Alternatively, the lower end of the plunger member 148 may have a chisel point so that it settles into one groove in the rack 38.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. A knee rehabilitation apparatus comprising:

a) at least one rail;

b) a foot cradle mounted on said rail and adapted for reciprocal movement along said at least one rail;

c) a base to which said at least one rail is fixed;

d) a resistance force means comprising at least one resistance band having one end connected to one end of said base and having its other end connected to the other end of said base and having an intermediate portion connected to an anchor point on said foot cradle wherein said anchor point further comprises a five-pin tensioning device further comprising five upstanding pins mounted in said foot cradle and forming a trapezoidal shape when view from above.

2. A knee rehabilitation apparatus in accordance with claim 1 further comprising means for securing a patient's foot to said foot cradle.

3. A knee rehabilitation apparatus in accordance with claim 1 further comprising a second rail fixed to said base and parallel to said at least one rail, with said foot cradle mounted on both said rails.

4. A knee rehabilitation apparatus in accordance with claim 1 further comprising a guide rail fixed to said base, with said guide rail parallel to and lying between said at least one rail and said second rail and a groove in a bottom surface of said foot cradle, said groove adapted to allow said foot cradle to ride along said guide rail.

5. A knee rehabilitation apparatus in accordance with claim 4 further comprising means for measuring the distance said foot cradle moves along said base, said measuring means further comprising a first measuring rule fixed to said base on a right side strip of said base and a second measuring rule fixed to said base on a left side strip of said base.

6. A knee rehabilitation apparatus in accordance with claim 1 further comprising means for securing the proximal end of a patient's leg to a proximal end of said base.

7. A knee rehabilitation apparatus in accordance with claim 1 further comprising means for stopping said foot cradle and rendering it stationary at any selected location along said at least one rail and means for restoring free reciprocal movement along said at least one rail, said stopping means further comprising a vertically oriented handle mounted in a handle bracket of said foot cradle, said handle having a depending plunger member adapted to engage the teeth of a rack mounted on said base when said handle is pushed down in said handle bracket, whereby reciprocal movement of said foot cradle is stopped and said depending plunger member of said handle disengages from said rack when said handle is raised, whereby the potential for reciprocal movement of said foot cradle is restored.

8. A knee rehabilitation apparatus comprising:

a) a base having a longitudinal channel along the length of said base;

b) a left side rail seated in said channel and fixed to said base;

c) a right side rail seated in said channel to said left side rail;

d) a foot cradle mounted on said left side rail and said right side rail and adapted for reciprocal movement along said rails;

e) a foot cup pivotally mounted on said foot cradle and further comprising means for restraining a patient's foot in said foot cup; and f) a proximal end resistance band having one end fastened to a proximal end of said base and the other end fastened to said foot cradle, whereby resistance is applied during the outward flexion of the knee joint and a distal end resistance band having one end fastened to a distal end of said base and having the other end fastened to said foot cradle, whereby resistance is applied during inward flexion of the knee joint; and g) means for stopping said foot cradle and rendering it stationary at any selected location along said at least one rail and means for restoring free reciprocal movement along said at least one rail, said stopping means further comprising a vertically oriented handle mounted in a handle bracket of said foot cradle, said handle having a depending plunger member adapted to engage the teeth of a rack mounted on said base when said handle is pushed down in said handle bracket, whereby reciprocal movement of said foot cradle is stopped and said depending plunger member of said handle disengages from said rack when said handle is raised, whereby the potential for reciprocal movement of said foot cradle is restored.

9. A knee rehabilitation apparatus comprising:

a) a base b) a left side rail fixed to said base;

c) a right side rail fixed to said base and parallel to said left side rail;

d) a guide rail having two ends, each end being fixed to said base, said guide rail lying between said left side rail and said right side rail, e) a rack further comprising a toothed bar having a plurality of evenly spaced upstanding teeth seated in said channel between said left side rail and said right side rail and fixed to said channel of said base;

f) a foot cradle mounted on said left side rail and said right side rail and adapted for reciprocal movement along said rails, said foot cradle further comprising a longitudinal groove along a lower surface of said foot cradle, said groove adapted to receive and be guided by said guide rail;

g) a foot cup pivotally mounted on said foot cradle and further comprising means for restraining a patient's foot in said foot cup; and h) a proximal end resistance band having one end fastened to a proximal end of said base and the other end fastened to said foot cradle, whereby resistance is applied during the outward flexion of the knee joint and a distal end resistance band having one end fastened to a distal end of said base and having the other end fastened to said foot cradle, whereby resistance is applied during inward flexion of the knee joint and a second resistance means comprising at least one resistance band connected to an anchor point on said foot cradle wherein said anchor point further comprises a five-pin tensioning device further comprising five upstanding pins mounted in said foot cradle and forming a trapezoidal shape when viewed from above.

10. A knee rehabilitation apparatus in accordance with claim 9 further comprising means for selectively stopping said foot cradle in a stationary position along said left side rail and said right side rail and means for restoring free reciprocal movement along said left side rail and said right side rail.

11. A knee rehabilitation apparatus in accordance with claim 9 further comprising a handle mounted in said foot cradle and adapted for selective up or down movement and a brake block depending from said handle for engaging said rack to stop said foot cradle.

* * * * *